US010088107B2

(12) United States Patent
Clüsserath

(10) Patent No.: US 10,088,107 B2
(45) Date of Patent: Oct. 2, 2018

(54) METHOD FOR PURGING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 274 days.

(21) Appl. No.: 14/775,880

(22) PCT Filed: Feb. 13, 2014

(86) PCT No.: PCT/EP2014/000394
§ 371 (c)(1),
(2) Date: Sep. 14, 2015

(87) PCT Pub. No.: WO2014/139624
PCT Pub. Date: Sep. 18, 2014

(65) Prior Publication Data

US 2016/0025267 A1 Jan. 28, 2016

(30) Foreign Application Priority Data

Mar. 14, 2013 (DE) ..... 10 2013 102 611

(51) Int. Cl.

| | |
|---|---|
| ***B65B 31/00*** | (2006.01) |
| ***F17C 5/00*** | (2006.01) |
| ***B67C 3/10*** | (2006.01) |
| ***B67C 3/12*** | (2006.01) |
| ***B67C 3/26*** | (2006.01) |

(52) U.S. Cl.
CPC ..... *F17C 5/007* (2013.01); *B67C 3/10* (2013.01); *B67C 3/12* (2013.01); *B67C 3/2617* (2013.01)

(58) Field of Classification Search
CPC ... F17C 5/007; B67C 3/10; B67C 3/12; B67C 3/2617
See application file for complete search history.

(56) References Cited

U.S. PATENT DOCUMENTS

2002/0139434 A1* 10/2002 Meheen ..... B67C 3/10 141/40

FOREIGN PATENT DOCUMENTS

| | | |
|---|---|---|
| DE | 37 31 757 | 3/1989 |
| DE | 42 07 829 | 9/1993 |
| DE | 298 07 610 | 5/1999 |
| DE | 199 39 521 | 9/2000 |
| DE | 10 2010 006 006 028 | 7/2011 |

* cited by examiner

*Primary Examiner* — Jason K Niesz
(74) *Attorney, Agent, or Firm* — Occhiuti & Rohlicek LLP

(57) ABSTRACT

A method for purging a container with a purgative gas before filling the container with liquid filling-material includes sealing the container against a treatment head, connecting the container to a vacuum source, thereby at least partially evacuating the container, and with the container still connected to the vacuum source, introducing purgative gas into the container such that pressure in the container is between 0.05 bar and 0.4 bar and any pressure change within the container during the introduction of purgative gas remains below 0.2 bar.

18 Claims, 5 Drawing Sheets

METHOD FOR PURGING CONTAINERS

RELATED APPLICATIONS

This application is the national stage under 35 USC 371 of international application PCT/EP2014/000394, filed on Feb. 13, 2014, which claims the benefit of the Mar. 14, 2013 priority date of German application DE 102013102611.7, the contents of which are herein incorporated by reference.

FIELD OF INVENTION

The invention relates to purging of containers with a purgative gas.

BACKGROUND

Various methods for filling containers are known. These include methods for free-jet filling and methods for pressure-filling.

In pressure filling, it is often useful to carry out certain operations on the container prior to actually filling it with liquid. Among these operations is that of purging the container's interior with purgative gas to purge gas out of the container's interior. Typical purgative gases are relatively inert gases such as carbon dioxide or nitrogen.

SUMMARY

Among the objects of the invention is that of providing a method that effectively purges a container interior with low consumption of purgative gas.

One particular feature of the invention is that, during purging, in a first method step, the container interior is evacuated by connection to a vacuum source, and then, in a second method step, the actual purging of the container takes place by the blowing in of the purgative gas while the container interior remains connected to the vacuum source.

As a result of the foregoing method steps, purgative gas takes is blown into the container against a vacuum in the container's interior.

The evacuation of the container in a first method step of the purging takes place, for example, in such a way as to create an under-pressure in the container. In some cases, the pressure is between 0.05 bar and 0.4 bar. In other cases, the pressure is between 0.05 and 0.25 bar, i.e. an under-pressure of between 0.6 bar and 0.95 bar, preferably 0.75 to 0.95 bar against the ambient pressure. The initiation of the blowing in of the purgative gas then takes place at such a pressure and/or with such a volume flow that a slight pressure rise occurs in the container interior, i.e. a pressure rise of, for example, a maximum of 0.1 bar to 0.2 bar.

Among the advantages of the foregoing method is a substantial reduction in the consumption of purgative gas. In fact, the method described herein can easily be carried out with up to ten times less purgative gas density or purgative gas quantity than conventional methods that are carried out under atmospheric or ambient pressure or at a pressure above atmospheric or ambient pressure.

The lower consumption of purgative gas represents a substantial costs saving. It is also possible, with the purging process according to the invention, for oxygen uptake during the subsequent filling to be substantially reduced.

In one aspect, the invention features a method for purging a container with a purgative gas before filling the container with liquid filling-material. Such a method includes sealing the container against a treatment head, connecting the container to a vacuum source, thereby at least partially evacuating the container, and with the container still connected to the vacuum source, introducing purgative gas into the container such that pressure in the container is between 0.05 bar and 0.4 bar and any pressure change within the container during the introduction of purgative gas remains below 0.2 bar.

Practices of the method include those in which the pressure is between 0.05 and 0.25 bar.

Additional practices of the method avoiding a pressure change in the container that is greater than 0.1 bar, and those that avoid a pressure change in the container altogether.

Some practices include adjusting the pressure of the purgative gas, the volume flow of the purgative gas, the pressure of the vacuum source, or any combination thereof so as to cause a purge pressure of between 0.15 bar and 0.45 bar.

Other practices include those in which connecting the container to the vacuum source includes connecting to the vacuum source through a first gas channel formed in the treatment head, and introducing the purgative gas into the container includes connecting the container to a second gas channel formed in the same treatment head.

Other practices include introducing purgative gas into the container by causing the purgative gas to flow in a stream along a central axis of the container or by extending a pipe into an interior of the container and introducing the purgative gas through the pipe.

Yet other practices include introducing purgative gas into the container by connecting the container to a gas chamber that contains a purgative gas under pressure and passing the purgative gas through a choke along a path to the container.

Other practices include monitoring purge pressure in the container. These include using a pressure sensor to monitor the purge pressure in the container. In some practices, the pressure sensor is independent of pressure sensors associated with other treatment heads. In others, the pressure sensor also monitors purge pressures of other containers that are sealed against other treatment heads.

Practices of the invention are not limited to those in which a filling head is used. Practices also include using other kinds of treatment heads. However, in those practices that do happen to use a filling head as the treatment head, the same treatment head fills the container with the liquid filling-material.

The purgative gas can come from several sources. In one practice, the source is independent of filling pressure used for filling the container. In other practices, the purgative gas comes from a tank that is also used to hold the liquid filling-material. This means that the purging pressure will be the same as the filling pressure.

The introduction of purgative gas can be carried out in one continuous stream. However, some practices call for an interrupted stream with flow periods and pause periods.

For example, in one practice, introducing purgative gas into the container comprises allowing purgative gas to flow during a first purge interval, interrupting purgative gas flow, waiting for a pause time to lapse, and after the pause time has elapsed, once again allowing flow of purgative gas for a second purge interval. The cycle of interrupting purgative gas flow and resuming flow of the purgative gas can be carried out one or more times. Among these practices are those in which the total pausing time is between half of the total purging time and 120% of the total filling time.

As used herein, "container" includes containers made of glass, including glass bottles, and similar stable containers made of metal or plastic, such as, for example, kegs, party barrels, and reusable plastic bottles. An essential feature is that the container have stability sufficient to avoid deformation or destruction thereof during the evacuation.

As used herein, a container is said to be in a sealed position with the processing head or filling element when it is pressed tightly against the processing head or filling element with its mouth forming a seal against it.

As used herein, "essentially" or "some" signifies deviations from an exact value in each case by ±10%, preferably by ±5%, and/or deviations in the form of changes that are of negligible significance for function.

Further embodiments, advantages, and applications of the invention can also be derived from the following description of embodiments and from the figures. All features described and/or pictorially represented are inherently independently or in any desired combination in principle the object of the invention, regardless of their combination in the claims or references made to them. The contents of the claims also form constituent parts of the description.

BRIEF DESCRIPTION OF THE FIGURES

These and other features of the invention will be apparent from the following detailed description and the accompanying figures, in which.

DETAILED DESCRIPTION

Figure 1:
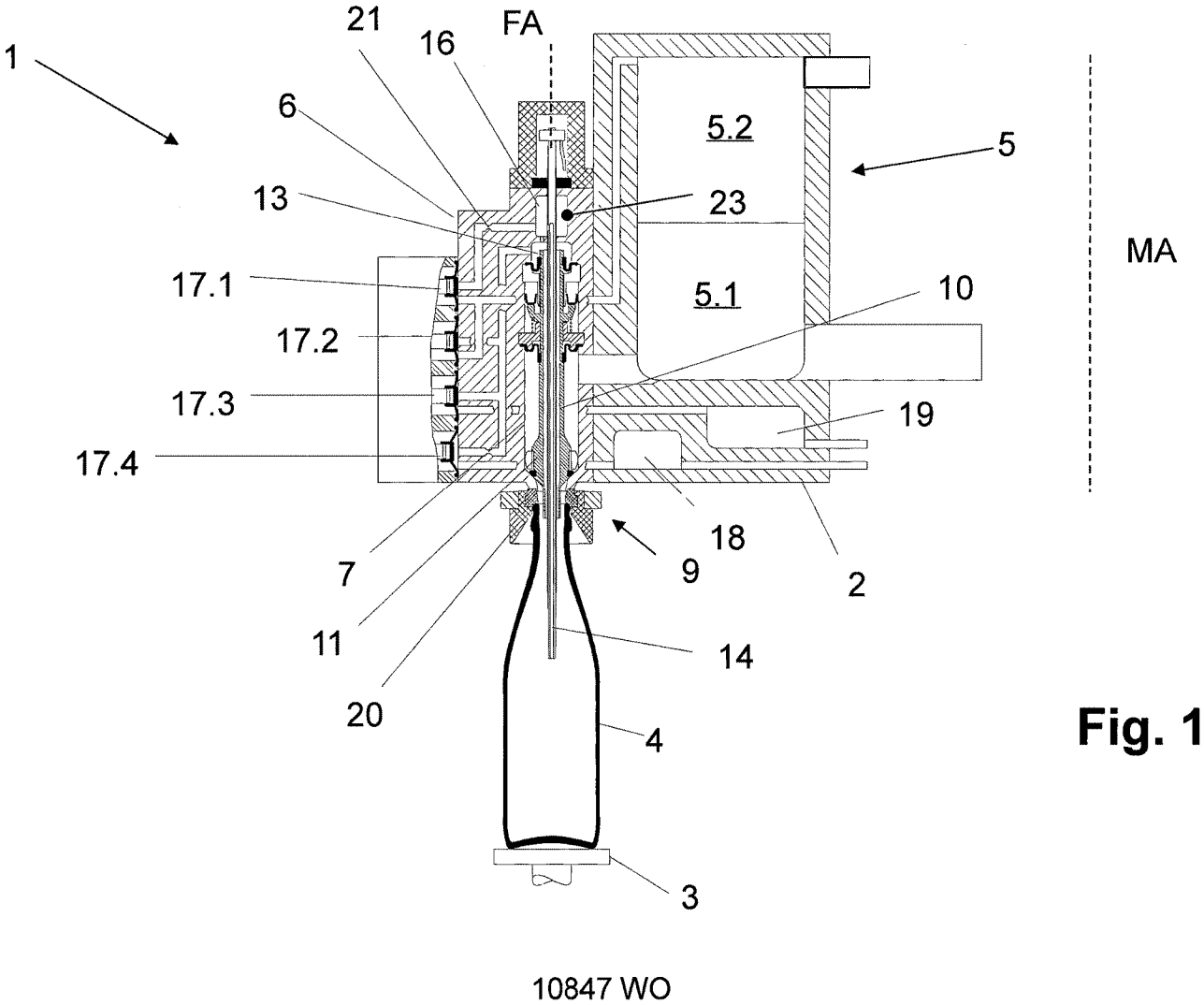
FIG. 1 shows a filling element on a rotor of a filling machine, together with a container sealed against the filling element.

FIG. 1 shows a rotor 2 having disposed, on a periphery thereof, a first filling-element 1 together with a carrier 3. Together, the first filling-element 1 and the carrier 3 define a filling point for pressure filling containers 4. These containers include bottles and cans made of glass, metal, or plastic. Additional filling points of the same type are arranged around the rotor's periphery. In operation, the rotor 3 rotates about a vertical machine axis MA.

Also arranged at the rotor 2 is a boiler 5 that holds liquid filling-material to be placed into containers. An example of a boiler 5 is a ring boiler. The boiler 5 is connected to and therefore common to all the filling elements 1. In operation, liquid filling-material fills a lower boiler-portion 5.1 and an inert gas fills an upper boiler-portion 5.2 at a filling pressure.

The lower boiler-portion 5.1 connects to a liquid-carrying channel 7 formed in a housing 6 of the first filling-element 1. At one end, namely on the underside of the first filling-element 1, the liquid-carrying channel 7 forms an annular outlet 8 that is concentric with a vertical filling-element axis FA.

The liquid-carrying channel 7 includes a liquid-dispensing valve 9 disposed therein. A tubular valve tappet 10 forms the valve body 11 of the liquid-dispensing valve 9. An actuation element causes the valve body 11 to move axially. This axial movement is what opens and closes the liquid-dispensing valve 9.

Figure 2:
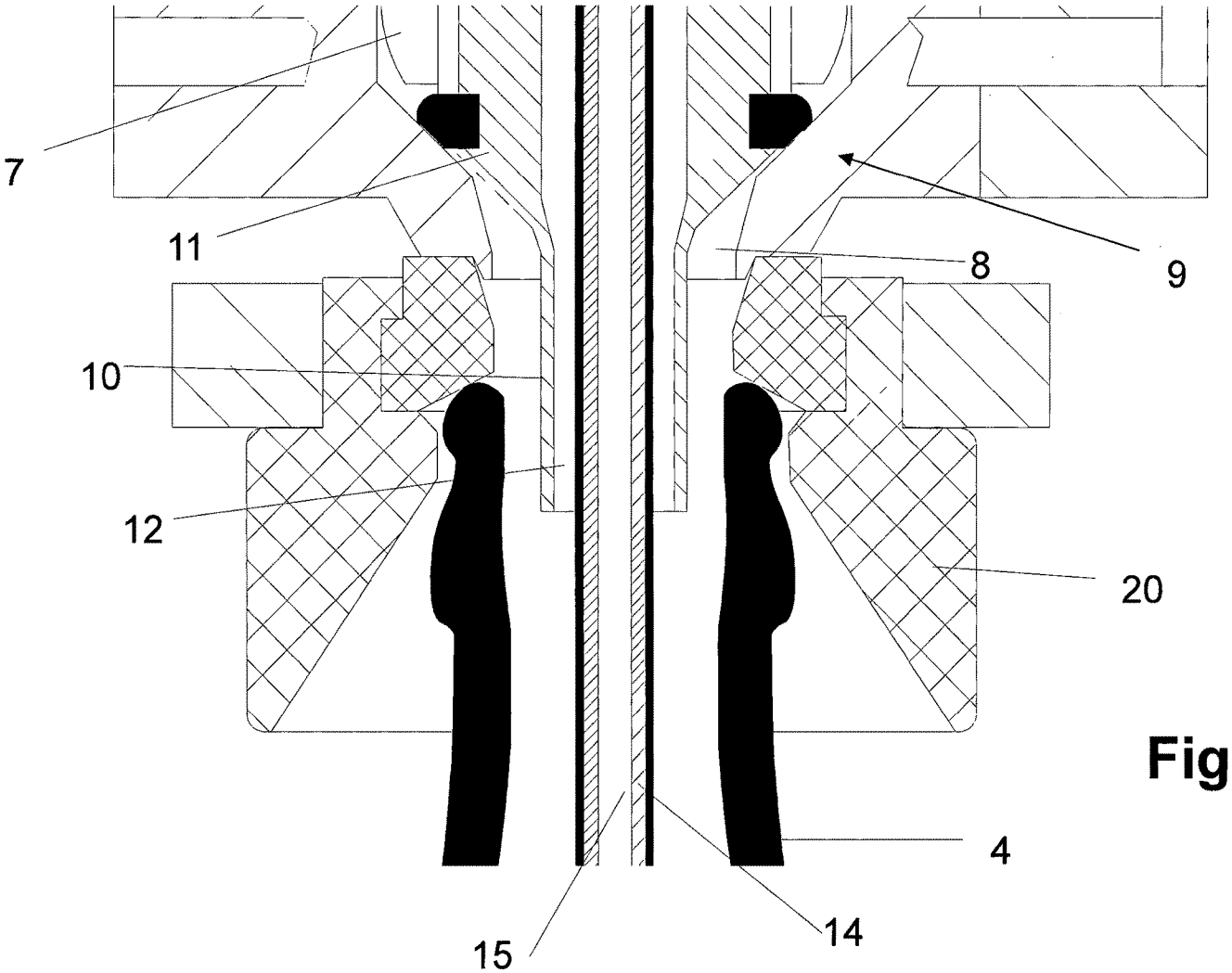
FIG. 2 shows a sectional view of the underside of the filling element from FIG. 1, together with a centering element.

The valve tappet 10 projects downward beyond the outlet opening 8, as shown in FIG. 2. Within it is a first gas-channel 12 having openings at its upper and lower ends.

Figure 3:
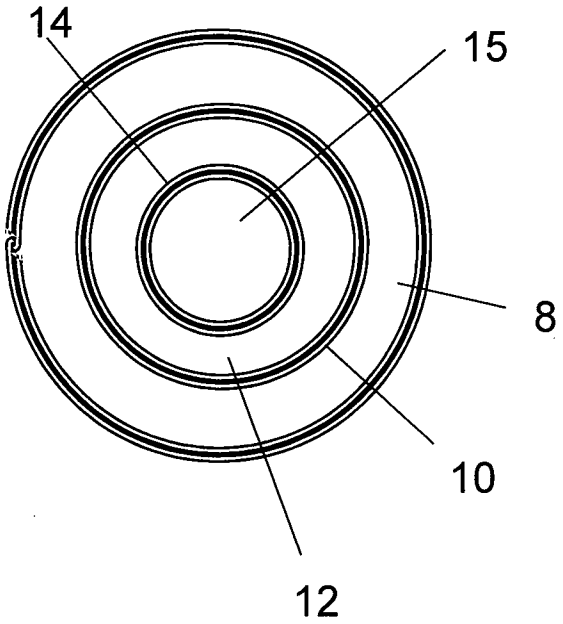
FIG. 3 shows a cross-section through the filling element of FIG. 1 in the region of an outlet opening, with a view of a tubular valve tappet and return gas pipe.

Also arranged coaxially with the filling-element axis FA is a return-gas pipe 14, which is best seen in FIG. 2. The return-gas pipe 14 projects beyond the lower end of the valve tappet 10 and into the interior of the container 4. During filling, the return-gas pipe 14 determines the filling height in the container 4. The return-gas pipe 14 defines a second gas-channel 15. As shown in FIG. 3, the first gas channel 12 surrounds the second gas channel 15.

As shown in FIG. 1, the second gas-channel 15 opens at the upper end of the return-gas pipe 14 into a second gas-chamber 16 formed in the housing 6. FIG. 1 also shows that the first gas-channel 12 opens into a first gas-chamber 13, also formed in the housing 6, at the top of the valve tappet 10.

The first and second gas-chambers 13, 16 are parts of different gas paths that are controlled by first, second, third, and fourth control-valves 17.1, 17.2, 17.3, 17.4 of the first filling-element 1. The first, second, third, and fourth control-valves 17.1, 17.2, 17.3, 17.4 enable the first and second gas-channels 12, 15 to be connected in a controlled manner with the upper boiler-portion 5.2 and with first and second ring channels 18, 19 that are also connected to all the filling elements 1 of the filling machine.

The first ring channel 18 is used to relieve stress on filled containers 4.

During the filling operation, the second ring channel 19 is subjected to a vacuum or under-pressure. The under-pressure in the second ring channel 19 is typically between 0.05 bar and 0.25 bar.

As it presses against a container 4, a centering element 20 forms a seal at the edge of the container's opening. As a result, the outlet opening 8 and the lower opening of the first gas-channel 12 open into an upper region of the container's interior.

The apparatus described herein enables effective purging of the container's interior without consuming too much purgative gas. The purging operation itself comprises first and second steps.

In the first step, the liquid-dispensing valve 9, the first control-valve 17.1, the second control-valve 17.2, and the fourth control-valve 17.4 are all closed. The third control-valve 17.3 is open. In this configuration, the container's interior is evacuated through the open third control-valve 17.3, the first gas-chamber 13, and the first gas-channel 12. In some practices, the container's interior is evacuated to a 95% vacuum or to a pressure between 0.05 bar and 0.25 bar.

In the second step, the third control-valve 17.3 and the first control-valve 17.1 are both open. This allows inert gas in the upper boiler-portion 5.2 to exit through the opened first control-valve 17.1 and into the second gas-chamber 16. On the way, the inert gas negotiates a choke 21. From the second gas-chamber 16, the gas continues into the second gas-channel 15, downward along the filling-element axis FA and into the container's interior, propelled to some extent by the vacuum created in the first step.

Since the return gas-pipe 14 extends deep into the container's interior, the gas emerging from the second gas-channel 15 reaches the bottom of the container 4. As it does so, it displaces gas already in the container's interior. The displaced gas travels out of the container 4 through the first gas-channel 12 and into the first gas-chamber 13. From there, the displaced gas continues on into the second ring channel 19 through the opened third control-valve 17.3.

The choke 21 restricts purgative gas flow to an extent that the under-pressure that results from having purged the container 4 at the end of the first method step rises only slightly, by some 0.1 bar to 0.2 bar. As a result, in the second method step, an inner pressure or purging pressure in the container 4 is always still substantially above the ambient pressure. In some embodiments, the inner pressure is above by between 0.15 bar and 0.45 bar.

In order to intensify the purging, the flow of gas into the container 4 during the second method step takes place without interruptions. As an alternative, the flow of incoming gas is broken up into in several stages. In either case, the purging of the container's interior can be intensified by maintaining an open connection between the container's interior and the second ring channel 19. However, maintaining such a connection is not essential.

It is likewise possible for the purging to be repeated several times for a particular container 4. This means that the first and second steps are repeated, possibly with variations between repetitions.

Figure 4:
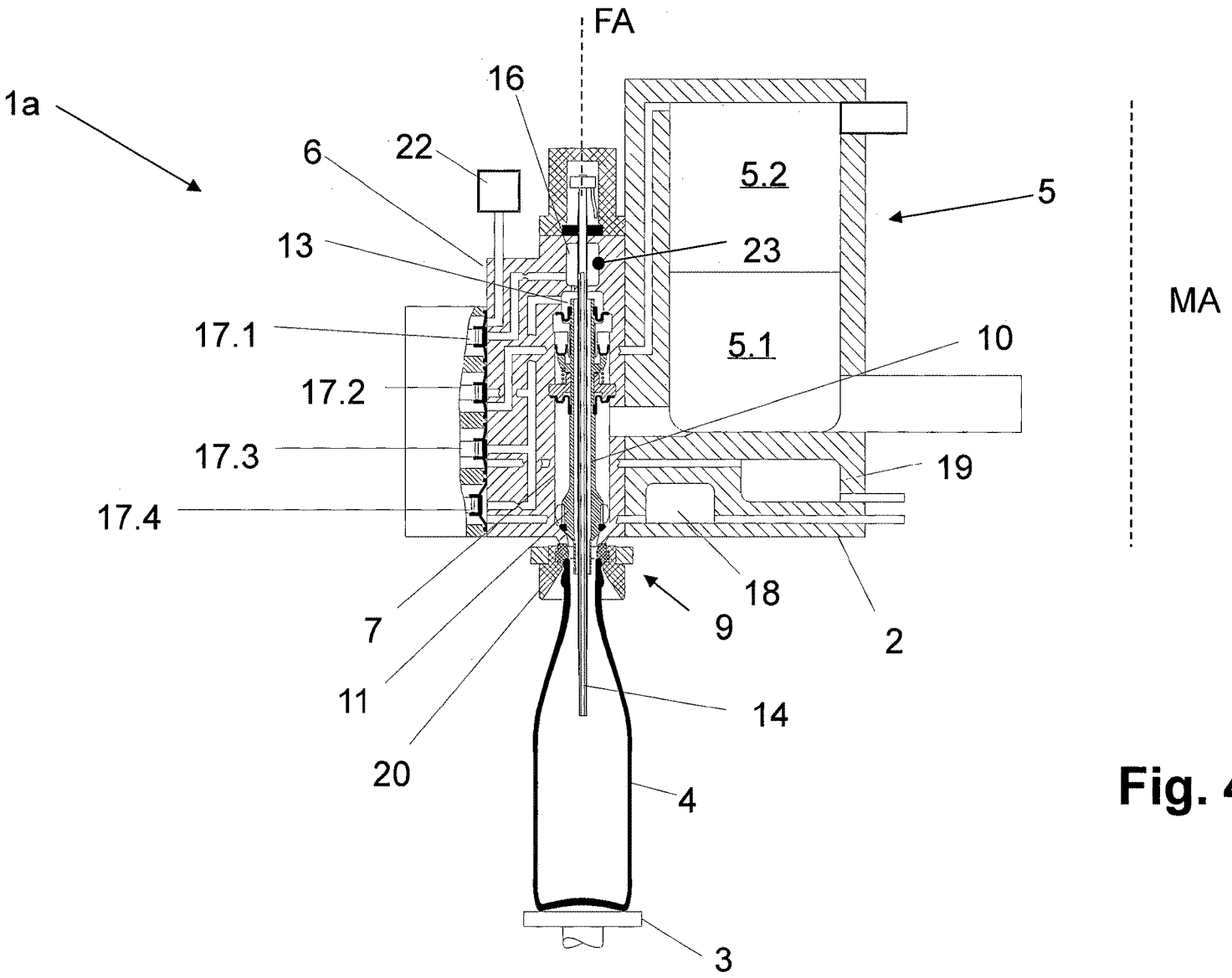
FIG. 4 shows another embodiment of a filling element on a rotor of a filling machine, together with a container sealed against the filling element.

A second filling-element 1*a*, shown in FIG. 4, differs from the first filling-element 1 only in that the first control-valve 17.1 on the input side is not connected to the upper boiler-portion 5.2. Instead, it is connected to a separate source 22 of purgative gas that is independently maintained at a selected overpressure. As a result, the pressure used for purging the container 4 no longer has to be the same as the pressure that is used to fill the container 4. In particular, using the embodiment shown in FIG. 4, it is possible to carry out the procedure with a purging pressure that is lower than the filling pressure.

Referring now to FIGS. 1 and 4, the second gas-chamber 16 is in fluid communication with a pressure sensor 23. This pressure sensor 23 assists in regulating pressure in the container 4.

Figure 5:
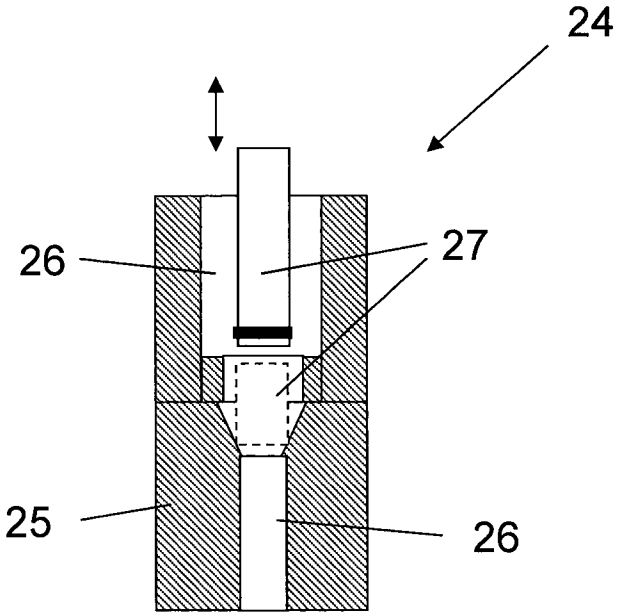
FIG. 5 shows a controllable gas valve for use with either of the filling elements from FIGS. 1 and 4.

Regulation is carried out using a fifth control-valve 24, as shown in FIG. 5. The fifth control-valve 24 functions as a choke in the gas channel that carries purgative gas. It transitions between an operating state, in which gas flows freely, and a choking state, in which it restricts gas flow. In some embodiments, the fifth control-valve 24 also has a blocking state.

As shown in FIG. 5, the fifth control-valve 24 has a valve body 25 with a narrowing flow channel 26 that functions as a choke. Depending on its axial position, an axially movable valve element 27 clears the flow channel 26, additionally narrows it, or closes it altogether.

The invention has been described by way of embodiments. It is understood that numerous changes and variations are possible without departing from the underlying inventive concept.

For example, purging has thus far been described as taking place at a filling element 1, 1*a*. However, there is no reason the same purging procedure cannot be carried out by a separate machine upstream of a filling machine using a separate purging head.

Preferably, purging lasts only a short time. With a 0.5 l container, a purging that lasts 150 to 300 milliseconds is optimal. Larger container volumes require correspondingly longer purges. Beyond this point, additional gas exchange becomes insignificant. As a result, longer purging processes are not economically viable.

It has however been shown to be advantageous if the optimum purging duration at which purging gas is blown in is interrupted by pauses during which no purgative gas enters. In one practice, the total duration of such pause times in approximately 0.5 to 1.2 times as long as the time during which purging gas is actively entering the container 4.

Having described the invention, and a preferred embodiment thereof, what is claimed as new, and secured by Letters Patent is:

1. A method for purging a container with a purgative gas before filling said container with liquid filling-material, said method comprising sealing said container against a treatment head, connecting said container to a vacuum source, thereby at least partially evacuating said container, and with said container still being connected to said vacuum source, introducing purgative gas into said container, wherein introducing said purgative gas into said container comprises adjusting a pressure in said container to be between 0.05 bar and 0.4 bar, avoiding a pressure change in said container that is greater than 0.2 bar, allowing purgative gas to flow during a first purge interval, interrupting purgative gas flow, waiting for a pause time to elapse, and after said pause time has elapsed, once again allowing flow of purgative gas for a second purge interval, wherein interrupting purgative gas flow and resuming flow of said purgative gas is carried out one or more times.

2. The method of claim 1, wherein adjusting a pressure in said container to be between 0.05 bar and 0.4 bar comprises adjusting said pressure to be between 0.05 and 0.25 bar.

3. The method of claim 1, wherein introducing said purgative gas into said container comprises avoiding a pressure change in said container that is greater than 0.2 bar comprises avoiding a pressure change in said container that is greater than 0.1 bar.

4. The method of claim 1, wherein introducing said purgative gas into said container comprises avoiding a pressure change in said container that is greater than 0.2 bar comprises avoiding a pressure change in said container.

5. The method of claim 1, further comprising adjusting pressure of said purgative gas to cause a purge pressure of between 0.15 bar and 0.45 bar.

6. The method of claim 1, wherein connecting said container to said vacuum source comprises connecting said container to said vacuum source through a first gas channel formed in said treatment head and wherein introducing said purgative gas into said container comprises connecting to said container through a second gas channel formed in said treatment head.

7. The method of claim 1, wherein introducing purgative gas into said container comprises causing said purgative gas to flow in a stream along a central axis of said container.

8. The method of claim 1, wherein introducing purgative gas into said container comprises extending a pipe into an interior of said container and introducing said purgative gas through said pipe.

9. The method of claim 1, wherein introducing purgative gas into said container comprises connecting said container to a gas chamber that contains a purgative gas under pressure and passing said purgative gas through a choke along a path to said container.

10. The method of claim 1, further comprising, using a pressure sensor, monitoring a purge pressure in said container.

11. The method of claim 10, wherein said pressure sensor is independent of pressure sensors associated with other treatment heads.

12. The method of claim 10, further comprising using said pressure sensor to monitoring purge pressures of containers that are sealed against other treatment heads.

13. The method of claim 1, further comprising filling said container with liquid filling-material using said treatment head.

14. The method of claim 1, wherein introducing purgative gas into said container comprises introducing purgative gas from a source that is independent of filling pressure used for filling said container.

15. The method of claim 1, wherein introducing purgative gas into said container comprises introducing purgative gas from a tank that is also used to hold said liquid filling-material.

16. The method of claim 1, wherein the sum of all pause times equals a first value, wherein the sum of all purge times equals a second value, and wherein said first value is equal to a product of said second value and a constant, and wherein said constant is between 0.5 and 1.2.

17. The method of claim 1, further comprising adjusting volume flow of said purgative gas to cause a purge pressure of between 0.15 bar and 0.45 bar.

18. The method of claim 1, further comprising adjusting a pressure of said vacuum source to cause a purge pressure of between 0.15 bar and 0.45 bar.

* * * * *